United States Patent [19]

Hosokawa et al.

[11] 4,192,131

[45] Mar. 11, 1980

[54] STEP MOTOR CONTROL MECHANISM FOR ELECTRONIC TIMEPIECE

[75] Inventors: Minoru Hosokawa; Hiroshi Ishii; Yoshikazu Kawamura; Sakiho Okazaki, all of Suwa, Japan

[73] Assignee: Kabushiki Kaisha Suwa Seikosha, Tokyo, Japan

[21] Appl. No.: 870,957

[22] Filed: Jan. 19, 1978

[30] Foreign Application Priority Data

Jan. 19, 1977 [JP] Japan ..... 52-4728
Jan. 28, 1977 [JP] Japan ..... 52-8465

[51] Int. Cl.[2] ..... G04C 3/00

[52] U.S. Cl. ..... 368/157; 318/685; 318/696; 368/219

[58] Field of Search ..... 58/23 R, 23 A, 23 D, 58/23 V, 4 R, 58; 318/685, 696

[56] References Cited

U.S. PATENT DOCUMENTS

| | | | |
|---|---|---|---|
| 3,742,697 | 7/1973 | Hama | 58/23 A |
| 3,812,670 | 5/1974 | Nikaido | 58/23 R |
| 4,032,827 | 6/1977 | Dobratz | 58/23 D |
| 4,087,959 | 5/1978 | Laesser | 58/58 |
| 4,158,287 | 6/1979 | Nakajima et al. | 58/23 A |

*Primary Examiner*—J. V. Truhe
*Assistant Examiner*—William L. Feeney
*Attorney, Agent, or Firm*—Blum, Kaplan, Friedman, Silberman & Beran

[57] ABSTRACT

A step motor driving and control mechanism for use in an electronic timepiece for reducing the current consumption thereof is provided. Load detection circuitry detects the load condition of the step motor by detecting the signals induced in the drive coil of the step motor after each stepping of the rotor. The load detection circuitry selectively produces a load condition signal in response to detecting current peaks representative of a predetermined load condition of the step motor. The load detection circuitry is characterized by the use of MOS transistors therein for accurately detecting the occurrence of the current peaks. Driving and control circuitry is provided for receiving a low frequency timekeeping signal produced by a divider circuit and a load detection signal, when same is selectively produced by the load detection circuitry. In response to the presence or absence of a load detection signal applied thereto, the drive and control circuitry is adapted to vary the duration of the pulse width of a drive signal applied to the step motor to effect a driving of same.

9 Claims, 22 Drawing Figures

STEP MOTOR CONTROL MECHANISM FOR ELECTRONIC TIMEPIECE

BACKGROUND OF THE INVENTION

This invention relates generally to a step motor driving mechanism in an electronic timepiece, and in particular to a step motor driving control circuit for reducing the current required to drive a step motor by applying drive signals having a pulse width of a duration corresponding to the load placed on the step motor.

The widespread acceptance of electronic wristwatches, having electronic movements and utilizing a quartz crystal vibrator as a time standard is, in large measure, a result of the extremely accurate timekeeping operation performed thereby, as well as the reliability offered by such wristwatches. One effort at improving the reliability of such timepieces has been directed to reducing the current consumption thereof, in order to reduce the rate at which the DC battery, utilized to energize same, is dissipated and thereby reduce the frequency with which the battery needs to be replaced.

Although the average power consumption of electronic wristwatches that were initially developed was on the order of 20 $\mu$W, the average power consumption has been reduced or approximately 5 $\mu$W. Specifically, in timekeeping circuitry which includes an oscillator circuit, divider circuit and control circuitry therefor, the average power consumption is 1.5 to 2.0 $\mu$W. The remaining power consumption occurs in the electro-mechanical converter of the electronic wristwatch and is on the average of 3 to 3.5 $\mu$W. Thus, the average power consumption resulting from the driving of the step motor, or other electro-mechanical converter, accounts for 60% to 70% of the entire power consumption of the electronic timepiece movement.

Although efforts have been made to reduce the power consumption of the electro-mechanical converter, these efforts have met with little success. Specifically, electro-mechanical converters have been developed that have a particularly high degree of efficiency and, hence, the reduction in power consumption, if any, that will be gained from increasing the degree of efficiency of the electro-mechanical converter would be substantially insignificant. Moreover, the electro-mechanical converting mechanisms utilized in electronic wristwatches often consume additional power as a result of the inclusion of temperature, calender and other environmental measurement mechanisms in the wristwatch. Also, an increase in power consumption results from vibration, shocks and other disturbances resulting from the normal use of the wristwatch. Accordingly, the electro-mechanical converting mechanism must be designed to effect driving of the gear train by the rotor under extreme operating conditions that can be anticipated.

For example, when a timepiece includes a calendar mechanism, an additional load is placed on the step motor four or five hours of the day, with little, or no, additional load being placed on the step motor the remaining twenty, or so, hours of the day. In order to accommodate the calendar mechanism in the wristwatch, the electro-mechanical converter mechanism must be designed to drive the motor under the worst conditions, namely, when the calendar mechanism is being operated, thereby resulting in unnecessary power consumption occurring during the remaining twenty, or so, hours of the day. Although efforts have been made to control the duration of the drive pulses applied to the step motor, such as those described in U.S. Pat. No. 3,855,781, such control was based on the physical position of the rotor and, hence, has been found to be less than completely satisfactory. Accordingly, an electronic wristwatch, wherein the current consumption of the step motor is substantially reduced by increasing the pulse width of the drive signal applied to the step motor, in relation to the load condition placed on the step motor, is desired.

SUMMARY OF THE INVENTION

Generally speaking, in accordance with the invention, an electronic timepiece having a step motor for driving a gear train is provided. The timepiece includes a high frequency time standard for producing a high frequency time standard signal and a divider circuit for producing a low frequency timekeeping signal in response to said high frequency time standard signal being applied thereto. A gear train is driven by the step motor and is adapted to place the rotor of the step motor in at least a first loaded condition, or a second loaded condition. A load detection signal is coupled to the step motor and is adapted to detect the signal induced in the drive coil of the step motor after the application of said drive signal to said drive coil and in response to the current peaks thereof produce a load signal representative of the load condition of the step motor. A driving and control circuit is disposed intermediate the driving circuit and the step motor for receiving the low frequency timekeeping signal from the dividing circuit and the load signal produced by the load detection circuit. The driving and control means, in response to the load signal, is adapted to apply to the step motor a drive signal having a pulse width of a duration that is proportional to the load placed upon the step motor.

The load detection circuit is characterized by the use of a plurality of C-MOS inverter stages wherein each stage is formed of C-MOS transistors having the same characteristics to thereby assure the accuracy of detecting the current peak induced in the line coil. Alternatively, current interruption means can be provided for selectively energizing each of the inverter stages for a short interval of detection to thereby reduce the power consumption of the load detection circuit.

Accordingly, it is an object of this invention to provide an improved small-sized electronic timepiece wherein the current required to drive the step motor is minimized.

A further object of the instant invention is to improve the power consumption of the electro-mechanical converting mechanism in an electronic wristwatch by reducing the power consumed in driving the electro-mechanical converter mechanism when the load placed thereon is reduced.

Still a further object of the instant invention is to provide electronic drive and control circuitry for applying a drive signal having a pulse width which varies in duration in response to the load placed upon the step motor.

It is another object of the instant invention to provide an improved load detection circuit comprised of C-MOS inverter stages.

Still another object of the instant invention is to provide a load detection circuit that admits of reduced current consumption during operation.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
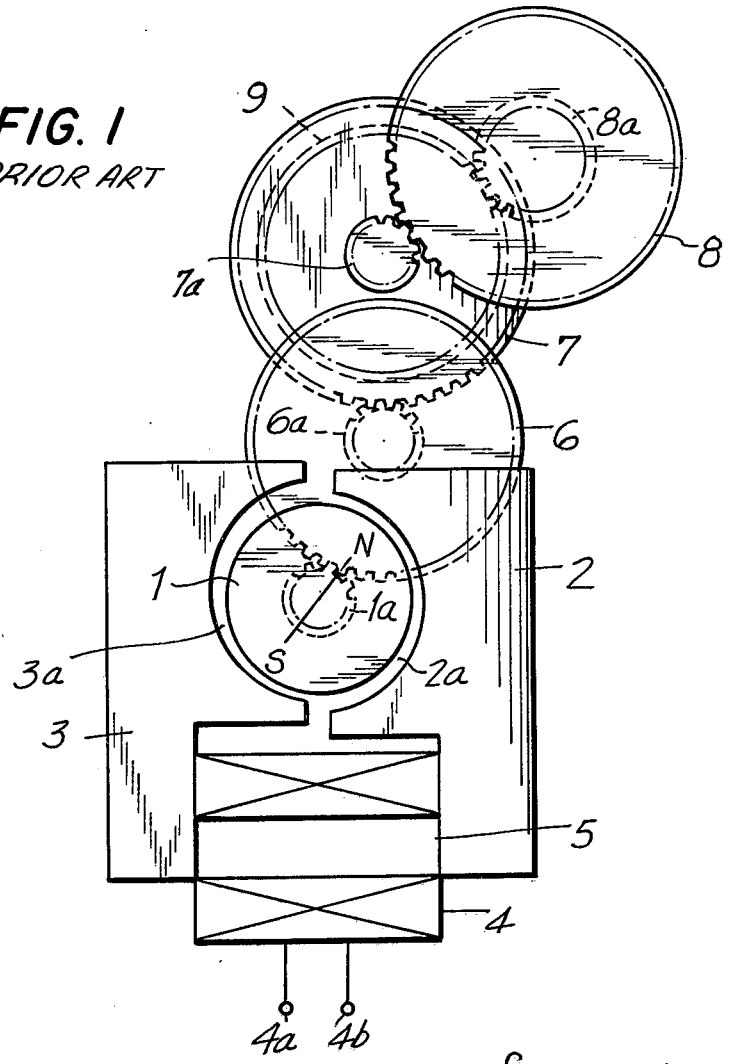
FIG. 1 PRIOR ART
FIG. 1 is a plan view of an electro-mechanical converter mechanism of an electronic wristwatch constructed in accordance with the prior art.

Reference is now made to FIG. 1, wherein an electromechanical converter mechanism, for converting the timekeeping signals produced in an electronic wristwatch into an incremental advancement of the gear train and constructed in accordance with the prior art, is depicted. The electro-mechanical converter mechanism includes a step motor comprised of an oppositely poled permanent magnet rotor 1 having two stator poles 2 and 3 disposed therearound, a stator yoke 5 connecting the respective stator poles, and a drive coil having terminals **4*a* and 4*b* surrounding the yoke. The portions of the stator poles 2*a* and 3*a*** surrounding the permanent magnet rotor are coaxially offset with respect thereto in order to assure that the rotor is rotated in a predetermined rotational direction. Accordingly, the step motor is operated in a conventional manner by reversing the polarities of both stator poles with respect to each other to thereby effect a rotation of the magnetic rotor through a 180° rotation, in response to each change of polarity of the stator poles.

The polarity of the stator poles is alternately reversed in response to the alternating polarity drive signal applied to terminals **4*a* and 4*b* of drive coil 4. The drive signal is produced by a conventional electronic timepiece movement, of the type illustrated in FIG. 2. Specifically, a high frequency time standard, such as a quartz crystal vibrator 10, is coupled to an oscillator circuit for producing a high frequency time standard signal fn. A divider circuit 12, comprised of a plurality of series-connected divider stages, is adapted to receive the high frequency time standard signal produced by the oscillator circuit 11, and produce a low frequency timekeeping signal fo in response thereto. A wave shaping circuit 13 receives the low frequency timekeeping signal fo and applies, through leads 16 and 17 and amplifiers 14 and 15, respectively, pulse signals that are alternately applied to the drive coil 4** to thereby induce an alternating polarity signal every second.

Specifically, a drive signal having a pulse width of 7.8 m-sec. in duration is applied every two seconds to the input terminals 16 of C-MOS inverter amplifier 14 and, hence, to the input terminal **4*a* of the drive coil 4. Additionally, every two seconds, a driving signal having a pulse width of 7.8 m-sec. duration is applied to input terminal 17 of C-MOS inverter 15, and, hence, to terminal 4*b* of the drive coil 4, to thereby alternately induce, in the drive coil 4**, a driving pulse of alternating direction to thereby reverse the polarities of the stator poles with respect to each other of the step motor once each second.

Figure 3:
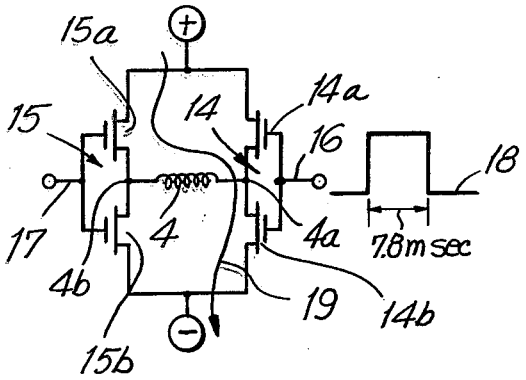
FIG. 3 is a detailed circuit diagram of a step motor driving circuit constructed in accordance with the prior art.

Referring specifically to FIG. 3, a step motor driving circuit, of the type utilized to drive the step motor depicted in FIG. 1, is illustrated, When, for example, a drive signal 18, having a 7.8 m-sec. duration, is applied to input terminal 16 of C-MOS inverter 14, a current flow in the direction indicated by the arrowed line 19 is effected from the positive terminal through the transistor **15*a*, drive coil 14, transistor 14*b* and the negative terminal. Alternatively, when a drive signal having a 7.8 m-sec. duration is applied to input terminal 17**, a current flow that is symmetrical to the current flow described above, when the drive signal is applied to input terminal 16, is effected. Accordingly, the current flow and, hence, polarity of the pulse signal induced in the drive coil 4 is alternated in response to the pulses of the drive signals being alternately applied to the input terminals 16 and 17 of the driver circuit. If the signals applied to drive coil 4 have a pulse width of 7.8 m-sec. duration, an opposite polarity drive signal, having a pulse duration of 7.8 m-sec., will be alternately induced in the drive coil 4 of the step motor in the manner noted above.

In response to each opposite polarity pulse, induced in the drive coil 4, rotor 1 is stepped through a rotation of 180°. The rotation of the step motor is transmitted through a pinion 1*a* to an intermediate wheel 6. The rotation of the intermediate wheel 6 is, in turn, transmitted through the intermediate wheel pinion 6*a* to the fourth wheel 7 and, hence, through the fourth wheel pinion 7*a* to the center wheel 8 and center wheel pinion 8*a*, which, in turn, transmits an incremental rotary motion to a cannon-pinion wheel 9. Cannon-pinion wheel 9 advances an hour wheel (not shown), a calendar mechanism (not shown) and any other wheels that are required to effect the display of time information. The intermediate wheel 6, fourth wheel 7, third wheel 8, cannon-pinion wheel 9, etc., comprise the gear train of the timepiece, and place a selectively variable load upon the step motor, in a conventional manner, when the second hand, minute hand, hour hand and/or calendar display are incrementally rotated thereby.

When a current flow is affected through the driver circuit, depicted in FIG. 3, in the manner indicated by the arrowed line 19, a voltage drop occurs as a result of the channel impedance of the MOS transistor 15*a*, which drop is detected at the terminal 4*b* of the drive coil 4.

Figure 4:
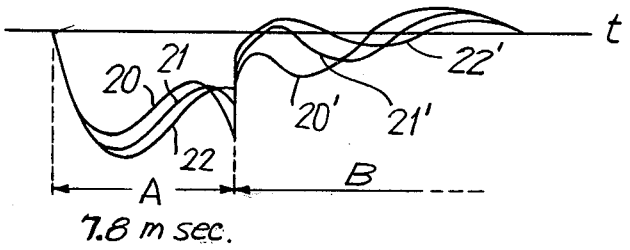
FIG. 4 is a wave diagram illustrating respective drive signals in the drive coil of a step motor in response to various load conditions placed thereupon.

An illustration of the form of the drive signal induced in the drive coil 4 in response to the drive signal 18 being applied to input terminal 16, is depicted in FIG. 4. Specifically, the interval A illustrates the current characteristic induced in the drive coil during the 7.8 m-sec. duration that the driving signal pulse is applied to the input terminal 16, whereafter, the interval B illustrates the current induced in the drive coil once the 7.8 m-sec. pulse drive signal is no longer applied to the input terminal 16. The shape of the wave form, during the interval A, results from currents induced in the drive coil by the rotation of the magnetic rotor, in addition to the current induced in the drive coil 4 as a result of the voltage driving pulse applied thereto. As illustrated in the interval B, the rotor continues to rotate as a result of inertia and to vibrate until the rotor stops at a stable position, thereby causing fluctuations in the current wave form during the interval B. During the interval B, the P-channel MOS transistors of the C-MOS inverters, 14 and 15, are turned ON and, accordingly, a current flow is induced in the drive coil in both directions, as a result of the oscillatory motion of the rotor. The shape and characteristic of the driving current wave form and of the wave form induced in the drive coil differ in accordance with the speed and positioning of the rotor when same is rotated.

The wave forms 20, 21 and 22 in FIG. 4, respectively, illustrate the current characteristics of the drive coil 4 when an extremely small or negligible load is placed on the rotor, a medium load is placed on the rotor, and an excessive load is placed on the rotor. The wave forms contained in FIG. 4 illustrate that the greater the load on the rotor, the farther to the right that the current peaks occur. This is a result of the rotor slowing down as the load placed upon the rotor increases. Accordingly, FIG. 4 illustrates that the frequency of the rotor is substantially reduced when the rotor is rotated to its next position in a highly stable manner. Stated otherwise, if the rotor has substantially no load thereupon, the pulse width of the driving signal can be reduced to a duration substantially less than 7.8 m-sec.

Figure 5:
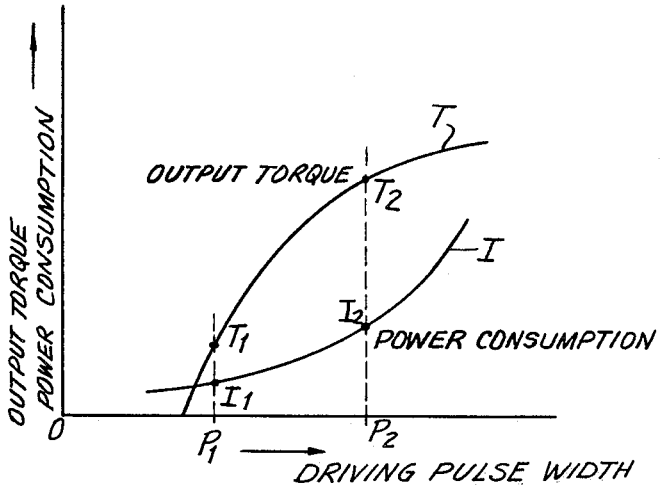
FIG. 5 is a graphical illustration comparing the relationship between the power consumption and output torque of a step motor resulting from changes in the duration of the pulse width of the drive signal applied thereto.

This relationship is illustrated in FIG. 5, wherein changes in the characteristics of the output torque of the rotor T and the power consumption I, as a result of changes in duration of the pulse width of the driving signal applied to the drive coil 4, are compared. Specifically, the pulse width duration of 7.8 m-sec. corresponds to $P_2$. Thus, for a pulse width $P_2$, an output torque $T_2$ is obtained with a resulting power consumption $I_2$. Accordingly, the output torque is related to the load placed upon the rotor. If the load on the rotor is small or, in fact, negligible, the output torque needed to effect driving of the gear train can be reduced, thereby resulting in a substantial reduction in power consumption. An output torque $T_1$ is obtained, which is sufficient to drive the rotor when a negligible load is placed thereupon, when a driving signal having a pulse width with a duration $P_1$, is applied and thereby results in power consumption $I_1$. A comparison of the substantially reduced torque $T_1$ and power consumption $I_1$ for a pulse width having a duration $P_1$, when compared with the torque and power consumption for a considerably longer pulse width $P_2$, indicates the clear reduction in power consumption that can be obtained if the pulse width of the drive signal is substantially reduced. To this end, the instant invention is directed to applying a narrow pulse width drive signal to the step motor and for increasing the pulse width of the drive signal when the load placed upon the step motor in increased, to thereby appropriately reduce the power consumption of the electro-mechanical converter mechanism.

As aforenoted, a negligible load is placed upon a step motor for approximately twenty hours a day, when a wristwatch has a calendar mechanism. A considerable reduction in power consumption is, therefore, effected if the pulse width of the drive signal is substantially reduced during the twenty hour period that the load is negligible. As illustrated in FIG. 5, the rotor can be driven by a drive signal having a pulse width $P_1$ for approximately twenty hours of the day, and by a drive signal having a second pulse width $P_2$ for the other four hours of the day, when a greater load is placed upon the rotor by the calendar mechanism. If such an approach is utilized, and $I_1/I_2=\frac{1}{2}$, the average reduction in power consumption would be computed as follows:

$$I=(I_1\times 20+I_2\times 4)/24=14/24\ I_2=0.58\ I_2$$

Figure 2:
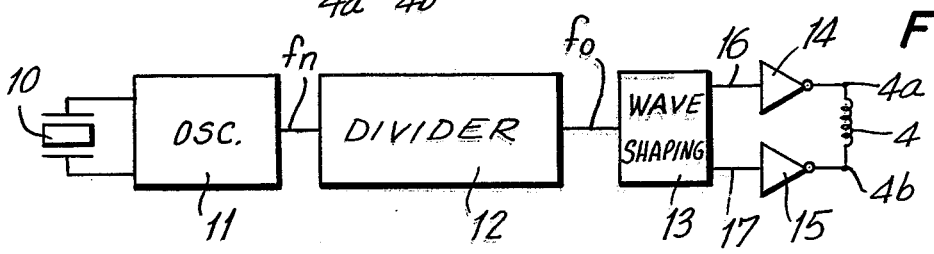
FIG. 2 PRIOR ART
FIG. 2 is a block circuit diagram illustrating the electronic movement of an electronic wristwatch constructed in accordance with the prior art.

The reduction in power consumption would therefore be approximately 60% of that normally obtained by utilizing conventional circuitry of the type depicted in FIGS. 1 through 3, wherein a drive signal having a 7.8 m-sec. duration pulse is utilized to drive the step motor.

It is noted that the manner in which the magnitude of the load placed upon the rotor is detected is an important aspect of the instant invention. Specifically, as illustrated in FIG. 4, the wave form of the current signal induced in the drive coil varies as the load placed upon the rotor increases. The positions at which the wave form reach maximum and minimum peaks, during the driving interval A, are shifted to the right and, hence, in duration, as the load increases. Although the relative magnitude of the load placed upon the rotor can be detected by utilizing the maximum and minimum current peaks, during the drive interval A, the differences during the driving interval A are sufficiently small so as to render it difficult to detect the relative differences in magnitude of the load placed upon the rotor. This difficulty is compounded by the fact that the current characteristics will change from rotor to rotor due to mass production techniques, etc.

Accordingly, the instant invention is particularly characterized by the use of the interval B immediately following the drive interval A, which interval is the interval of time immediately following the falling edge of the drive signal 18. It is noted that in the latter interval B, the respective current characteristics illustrate that a minimum peak is reached at a time that is directly related to the load placed upon the rotor. Specifically, the curve 20' illustrates that a minimum peak can first be detected at a time considerably before the minimum current peak 22' when a heavy load is placed upon the rotor. Moreover, the magnitude of difference between relative current minimums, in the after interval B, is considerably larger than the difference between minimum and maximum peaks in the drive interval A. The instant invention detects the magnitude of the load by detecting the induced current wave form in the drive coil 4 after the predetermined pulse of the driving signal is applied thereto. It should also be noted that this relationship between current peaks and the load applied to the rotor occurs for any pulse width, notwithstanding whether or not the pulse width is extremely narrow, or extremely wide.

Figure 6:
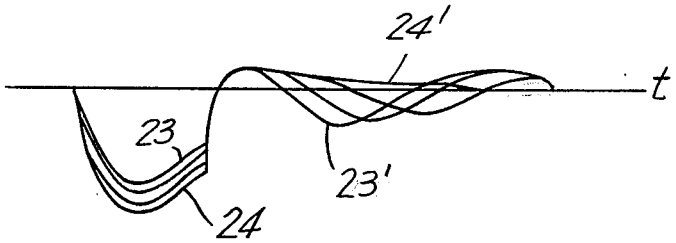
FIG. 6 is a wave diagram illustrating changes in the current induced in the drive coil of a step motor in response to variations in the duration of the pulse width of the drive signal applied thereto.

For example, in FIG. 6, the signals 23 and 24 represent a no-load condition and a maximum-load condition, respectively. It is noted that the same relationship between the current induced during the after interval occurs when the pulse width is shortened, namely, a relative current minimum occurs in the current signal 23' when no load is placed on the rotor sooner than it occurs in the current signal 24', in the after signal, when the rotor has a large load placed thereupon. Accordingly, in the instant invention, the motor is usually driven by a narrow driving pulse. Specifically, a predetermined condition that substantially no load is placed upon the rotor is assumed. Also, the magnitude of the load is always detected in the after drive interval, when each of the currents are induced in the drive coil, as a result of the rotation of the rotor. Moreover, when an increased load is placed upon the rotor, the instant invention detects this condition, and applies a driving pulse, having a longer duration for the period of time that the additional load placed upon the rotor is detected, after which the predetermined narrow pulse width drive signal is, once again, utilized to drive the step motor.

Figure 7:
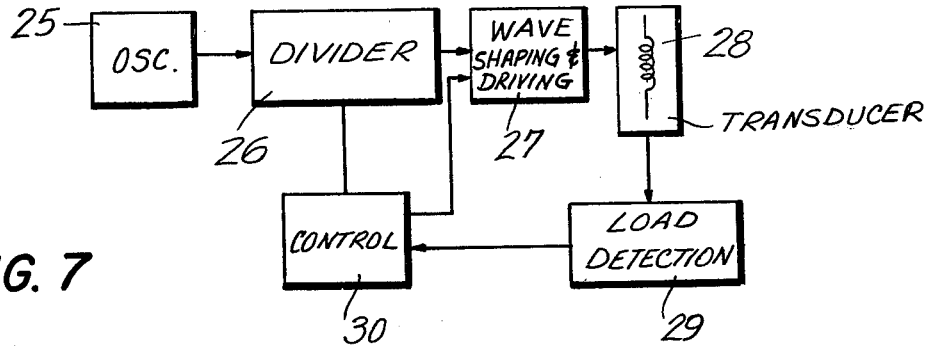
FIG. 7 is a block circuit diagram of an electronic wristwatch constructed in accordance with a preferred embodiment of the instant invention.

Reference is now made to FIG. 7, wherein a block circuit diagram, illustrating the operation of the step motor drive and control circuitry, of the instant invention, is depicted. An oscillator circuit 25 is coupled to the electronic timepiece circuitry, including divider 26, which divider applies a low frequency timekeeping signal fo to the wave shaping and driver circuit 27. The wave shaping and driving circuit 27 applies an alternating pulse signal to the drive coil of pulse motor 28, in the manner discussed in detail above. A load detection circuit 29 is adapted to detect the load placed upon the rotor, by detecting the current induced in the drive coil after the drive pulse has been applied to the drive coil of the step motor, in the manner explained in detail above. A control circuit 30 is coupled to the load detector circuit 29 and, in response to an intermediate frequency signal produced by the divider 26, and a load detection signal produced by load detector 29, which signal is representative of the load placed upon the rotor, control circuit 30 is adapted to control the duration of the pulse width of the drive signal applied to the pulse motor 28. Specifically, in response to detecting a no-load or minimum-load condition on the rotor, the control circuit 30 insures that a narrow drive pulse is applied to the drive coil and, in response to detecting a maximum load upon the rotor, a substantially wider driving pulse is applied to the drive coil of the step motor.

Figure 8:
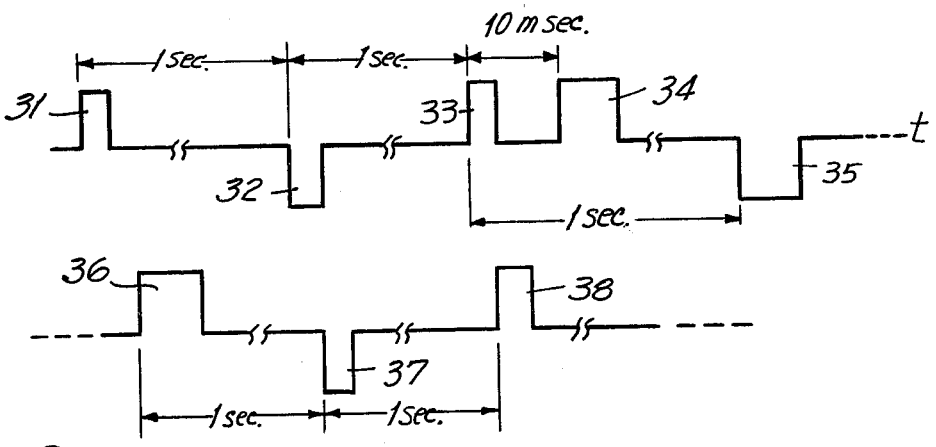
FIG. 8 is a wave diagram illustrating the operation of the electronic wristwatch depicted in FIG. 7.

Reference is now made to FIG. 8, wherein the manner in which the pulse width of the driving signal is controlled by the step motor driving and control circuitry of the instant invention, is depicted. Specifically, the positive and negative going drive pulses 31 and 32, induced in the drive coil 4 each second, affect a stepping of the rotor once each second, when a small or negligible load is placed upon the rotor. It is noted that the duration of the pulse width of pulses 31 and 32 are short. As aforenoted, after each short duration pulse is applied to the drive coil 4, the magnitude of the load placed upon the rotor is detected. If the predetermined narrow pulse width 31 is applied to the rotor, and substantially no load is placed upon the rotor, the rotor will be rotated and, accordingly, the next pulse 32 will have the same predetermined narrow pulse width. Similarly, after the predetermined negative polarity pulse 32 is applied to the drive coil, if substantially no load is placed upon the rotor, the next opposite polarity drive pulse 33 will also be a short duration drive pulse. It is noted, however, that if the load detected after the drive pulse 33 is applied to the drive coil is of a larger magnitude, after a period of ten m-sec., a second positive going drive pulse, having a wider pulse width but of the same polarity as pulse 33, will be applied to the drive coil 4. One second after the leading edge of pulse 33, a second wider pulse 35, of opposite polarity to wider pulse 34, is then applied to the drive coil 4, followed by a further plurality of wider pulses alternately applied to the drive coil, until a larger load is no longer placed upon the rotor, whereafter alternating narrow pulses 37 and 38 will again be applied to the drive coil at one second intervals.

It is noted that when the narrow pulse width 33 is applied to the rotor, and immediately thereafter, it is detected that an increased load has been placed upon the rotor, it is difficult to ascertain if the pulse width of the drive pulse 33 was sufficient to step the rotor. In any event, the increased load placed upon the rotor will clearly cause the current minimum of the induced current in the drive coil to be moved to the right, as depicted in FIGS. 4 and 6, and hence detected by the load detection circuitry if the rotor is rotated.

Because the rotor may not be rotated or may be rotated at a slow rate by the application of driving pulse 33 thereto, when an increased load is placed thereupon, it is difficult for the detection circuitry to distinguish whether or not the rotor has been rotated. In any event, by applying a second pulse 34 of wider duration than ten m-sec. after detecting that an increased load is, in fact, placed upon the rotor, if the rotor has already been rotated, pulse 34 will have no effect on the rotor since pulse 34 has the same polarity as pulse 33. However, if the increased load placed upon the rotor prevented same from being rotated in response to drive pulse 33 being applied thereto, or slowed down the rotation thereof, the increased duration pulse width will be sufficient to completely rotate the rotor. Accordingly, in the event that the second pulse 34 produced at least ten m-sec. after the first pulse 33 is applied to the drive motor is needed to rotate the rotor, the second hand will be advanced a small portion of a second later. It is noted, however, that the delay of twenty to thirty m-sec's in advancing the second hand will not be perceived by the wearer of the wristwatch. Finally, as indicated above, since the largest load placed upon the rotor in an electronic wristwatch is likely to be a result of the calender mechanism, a load that is applied for a period of three to four hours a day, the larger pulse width driving signal is applied to the drive coil for that duration of time, after which the narrow pulse width signals 37 and 38, once again, are applied to the step motor.

It is noted that other conditions that are likely to place an increased load upon the rotor are magnetic fields and/or low temperatures. However, these conditions often last for a short interval and, accordingly, the number of pulses having a longer duration can be limited from a range of ten to thirty seconds to ten to thirty minutes. To this end, the instant invention utilizes a timer in order to measure a predetermined time interval, which timer is explained in detail in the preferred embodiment depicted in FIG. 9.

Figure 9:
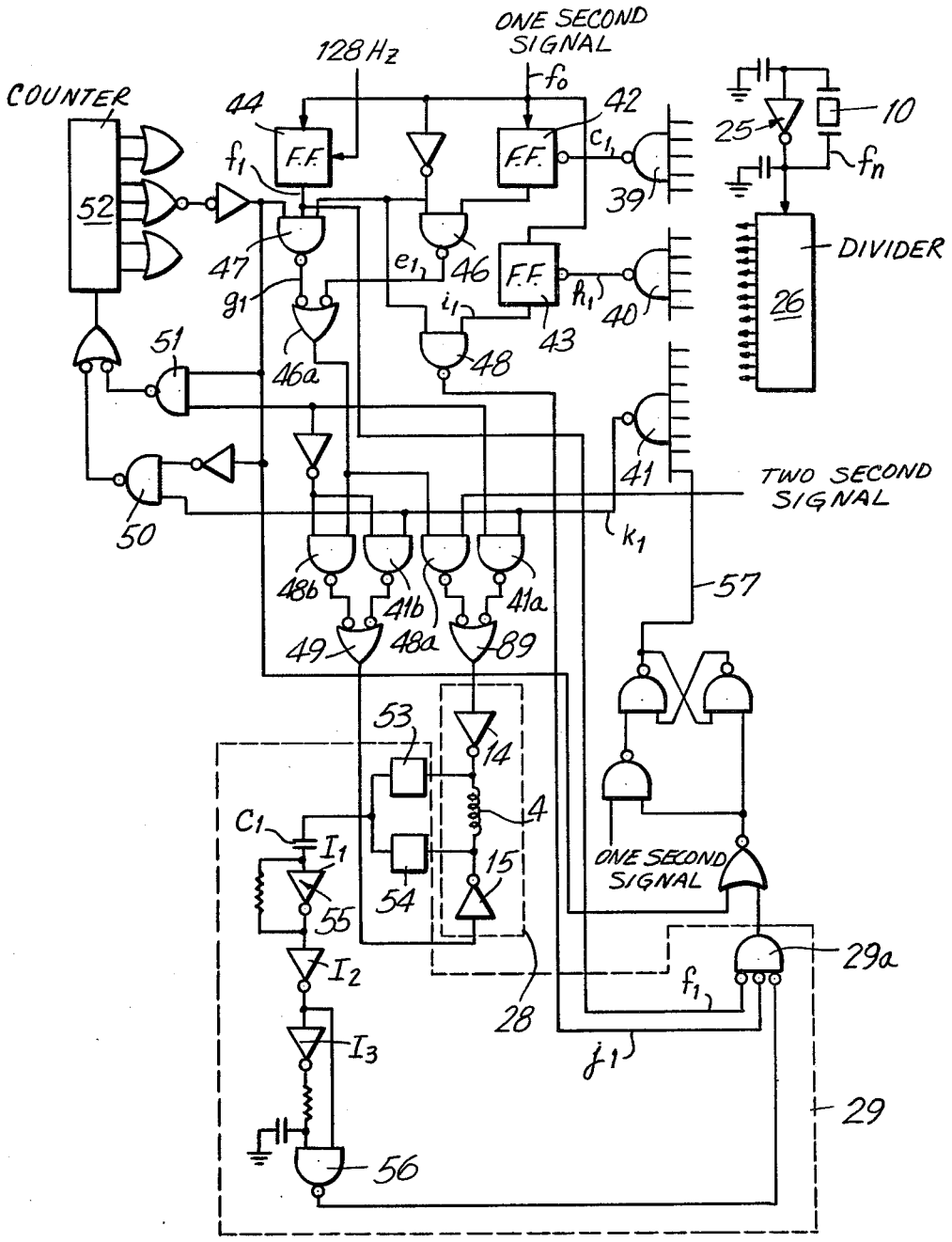
FIG. 9 is a detailed circuit diagram of the electronic wristwatch depicted in FIG. 7.

Turning now to FIG. 9, a detailed circuit diagram of an electronic wristwatch, including the step driving and control circuitry of the instant invention, is depicted, like reference numerals being utilized to denote like elements depicted above. A quartz crystal vibrator 10 is coupled to an oscillator circuit 25, for applying a high frequency time standard signal $f_n$ to divider 26. The motor wave shaping and driving circuitry, hereinafter "drive circuitry," includes drive coil 4 and is generally indicated as 28. The load detection circuit, generally indicated as 29, is provided for detecting the load placed upon the rotor by the gear mechanism in order to control the duration of the pulse width applied to the drive coil 4, in a manner to be discussed in greater detail below.

The output of NAND gate 39 is a clock signal $c_1$ and is utilized to shape the narrow pulses that are utilized to drive the motor when a no-load condition is placed thereupon. Specifically, the clock pulse $c_1$, produced at the output of NAND gate 39, is produced once every five m-sec., so that the delay flip-flop 42 produces a five m-sec. output signal $d_1$ every second. A pulse signal $e_1$, having a narrow pulse width of five m-sec. is, therefore, generated at the output of NAND gate 46 and is applied through OR gate 46*a* and NAND gates 48*a* and 48*b* to be applied as drive signals through OR gates 49 and 89, respectively. Flip-flop 44 is adapted to receive a one second signal and, additionally, as a clock input, a 128 Hz intermediate frequency signal produced by the divider circuit 26 and, in response thereto, is adapted to produce an output signal $f_1$ having a pulse width of 7.8 m-sec. once each second that the one second signal is applied thereto. Accordingly, a drive signal $g_1$ is produced at the output of NAND gate 47 having a pulse width of 7.8 m-sec., and is adapted, when a heavy load condition is placed upon the rotor, to apply through NAND gates 48*a* and 48*b* a driving signal having a pulse width of a lower duration (7.8 m-sec.) to drive the coil 4.

NAND gate 40 is adapted to receive intermediate frequency signals produced by the divider circuit 26 and produce a clock signal $h_1$ that is utilized to distinguish between the predetermined unloaded condition and a condition wherein a considerably greater load is placed upon the rotor. The pulses $h_1$, produced by the NAND gate 40, are utilized to detect the current minimum during the interval after the drive pulse is applied to the rotor. Specifically, the output signal $i_1$ from delay flip-flop 43, which occurs once each second, is gated through NAND gate 48, and is applied as a gate input signal $j_1$ to NAND gate 29*a* of the load detection circuit 29, in order to effect gating thereby of a load detection signal. Delay flip-flop 43 is controlled in the same manner as the delay flip-flops 42 and 44, by receiving the one second signal as a clock signal.

Figure 10:
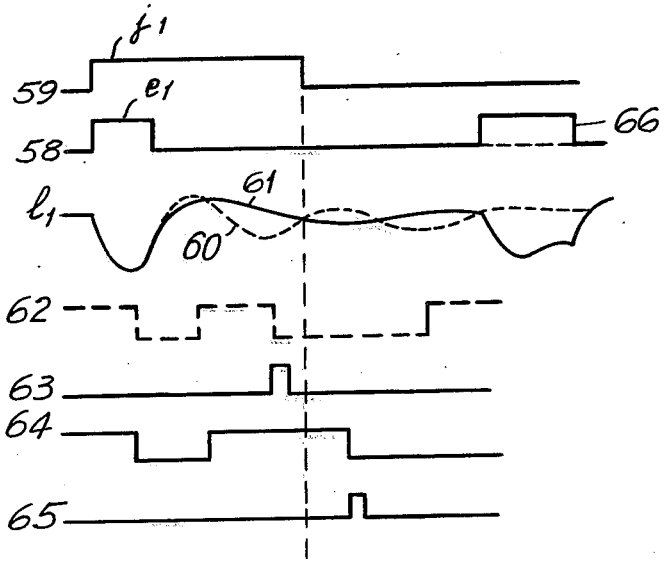
FIG. 10 is a wave diagram illustrating the operation of the electronic wristwatch depicted in FIG. 9.

Referring also to FIG. 10, the signal 58 is a narrow pulse signal produced at the output of NAND gate 46, whereas the signal 59 is the gating signal produced at the output of NAND gate 48. NAND gate 41 is utilized to generate a correction pulse $k_1$ having a pulse width of 7.8 m-sec., and is generated thirty m-sec. after the respective output signals from NAND gates 46 and 47 are produced. The pulse 66 is, therefore, produced at least thirty m-sec. after the falling edge of the gating signal 59. The input terminal 57 controls NAND gate 41 so that the correction signal is produced thereby in a manner described in detail below.

When the correction signal produced at the output of NAND gate 41 is a HIGH level signal, a correction pulse is supplied to NAND gates 41*a*, 41*b* and 50. As aforenoted, the input signals of NAND gates 39, 40 and 41 are the signals utilized to produce a pulse by combining the intermediate frequency signals produced by the respective divider stages of the divider circuit 26. NOR gates 89 and 49 are utilized to supply signals to each of the inverter-amplifiers 14 and 15 of the driving circuit 28 so that an alternating current driving pulse is generated in the drive coil 4 every second. When a HIGH level correction signal $k_1$ is applied at the output of NAND gate 41 to NAND gate 50, counter 52 is reset to zero, and thereby placed in a counting mode and begins to count in a manner discussed in detail below. When counter 52 starts to count, the gate 50 is turned OFF until the count of the counter 52, once again, returns to a count of zero. It is noted that the counter 52 begins counting because NAND gate 51 is open, so that a two second intermediate frequency signal can be applied through NAND gate 51 to the counter in order to effect counting thereby. Once the counter is indexed through a full counting cycle and returned to a count of zero, NAND gate 51 will receive the zero output count and inhibit the further application of the two second signal to the counter. Accordingly, as noted above, counter 52 is selected to provide a typical time interval within a range of twenty seconds to thirty minutes, so that same can function as a timer for determining the amount of time that the wider duration 7.8 m-sec. driving pulses should be applied to the drive coil 4. It is noted that NAND gate 47 receives the output of the counter 52 as gating input, and when same is counting, gates the 7.8 m-sec. driving pulse produced by the delay flip-flop 44 to NAND gates 48*a* and 48*b* during the entire time interval that the counter 52 is counting.

Detector circuit 29 detects the occurrence of a minimum in the current induced in the drive coil 4 after the driving pulse is applied thereto. Specifically, transmission gates 53 and 54 are respectively coupled to both sides of the drive coil for alternately receiving drive pulses applied to the opposite terminals of the drive coil, in the manner discussed in detail above. The transmission gates 53 and 54 receive the respective drive pulses, combine same and apply the combined signals through a capacitor $C_1$ to a differential amplifier 55.

The signals 60 and 61, in FIG. 10, respectively represent the signal $l_1$ produced at the output of the transmission gates 53 or 54, in response to a no-load condition placed upon the rotor, or a heavy-load condition placed upon the rotor. Accordingly, the differential amplifier 55 operates as a detector to detect the time at which the minimum current peaks occur. A series of inverters $I_1$, $I_2$ and $I_3$ receive the output of the $l_1$ from the transmission gates and invert same and square same to thereby define the wave form 62 in response to the load signal 60 and wave form 64 in response to the load signal 61. The NAND gate 56 detects the falling edge of signal 61 after the driving pulse 62 is applied and produces either a pulse 63, when a negligible load is placed upon the rotor, or a pulse 65, when a heavy load is placed upon the rotor. When the pulse 63 occurs, during the duration of the gating signal 59, a no-load condition is detected. However, when pulse 65 occurs after the falling edge of the gating signal 59, it results in the NAND gate 29*a* of load detection circuit producing a load detection signal representative of a heavy load condition placed upon the rotor.

Accordingly, a correction pulse 66 is applied to the timing circuitry when the signal 61, representative of a heavy load, is detected. As noted above, even if the rotation of the rotor is completed before the correction pulse 66 is produced as a result of a heavy load condition, the correction pulse is applied through AND gate 50 to the counter 52 to open the NAND gate 51 and permit the counter 52 to begin counting. Once the counter begins counting, NAND gate 51 remains open, so that a driving signal having a 7.8 m-sec. duration pulse width is continuously applied to the motor driving circuit 28 until the counter completes an entire counting cycle and no further correction pulses are being applied to NAND gate 50.

Accordingly, the instant invention is particularly characterized by the use of a counter for insuring that for at least a predetermined interval of time, such as ten to twenty seconds, a driving signal, having a pulse of longer duration, is applied to the step motor in order to insure that enough torque is imparted to the rotor to drive the additional load placed thereupon. Moreover, if the load detecting circuitry continues to detect the presence of a heavy load condition upon the rotor, the signal 66 will continue to be applied to the counter 52 and thereby effect continuous gating of the 7.8 m-sec. drive signal until the heavy load is removed from the rotor, whereafter a narrow pulse width drive signal will immediately be applied thereto.

The instant invention is further characterized by the detection of current peaks in the after interval after the driving pulse is applied to the drive coil of the step motor in order to produce a load detection signal representative of the load placed upon the rotor. To this end, the load detection circuit, and in particular the differentiator circuit including the inverter $I_1$ and the inverters $I_2$ and $I_3$, must accurately detect the occurrence of the minimum current peaks in the signal $l_1$ produced at the output of the transmission gates 53 and/or 54 to thereby assure that the duration of the drive signal, applied to the step motor, is properly varied in accordance with the load placed thereupon.

Figure 11:
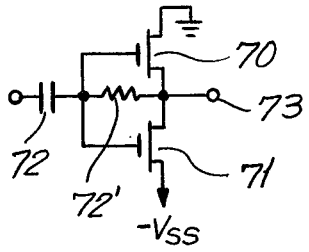
FIG. 11 is a circuit diagram of a load detection circuit constructed in accordance with the instant invention.

Reference is now made to FIG. 11, wherein a circuit diagram of a differentiator circuit, constructed in accordance with a preferred embodiment of the instant invention, is depicted. A C-MOS inverter stage, comprised of a P-channel transistor 70 and an N-channel transistor 71, includes a feedback resistor 72' coupled between the commonly coupled drain output terminal of the C-MOS inverter and the common gate input terminal of the C-MOS inverter. Input capacitor 72 is disposed intermediate the transmission gates and the gate input terminal of the C-MOS inverter in order to define a biasing level that is approximately one-half the supply voltage $-V_{SS}$ when the input signal, applied through capacitor 72, is a zero level signal. The biasing voltage is produced in response to the flow of current through the transistors 70 and 71 to thereby define a voltage drop in accordance with the channel resistances of the respective C-MOS transistors. Accordingly, the flow of biasing current, through the C-MOS transistors, occurs when the rotor is not being rotated, as well as during the after interval that the rotor is detected, thereby causing current to be consumed in the differentiator circuit at a time that the differentiator circuit is not being utilized to detect current peaks.

Figure 12:
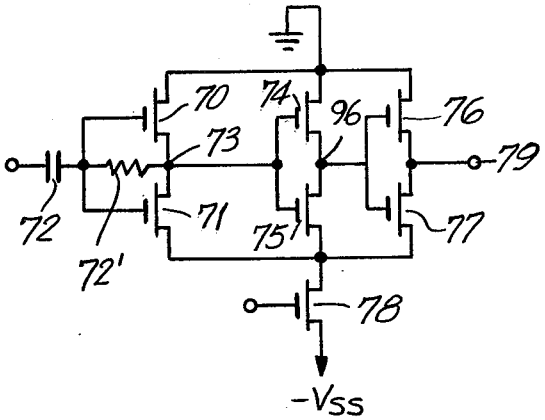
FIG. 12 is a circuit diagram of a preferred embodiment of a load detection circuit constructed in accordance with the instant invention.

Reference is therefore made to FIG. 12, wherein a load detection differentiator and inverter circuit, constructed in accordance with a preferred embodiment of the instant invention, is depicted, like reference numerals being utilized to denote like elements depicted above. In addition to the first C-MOS inverter stage, comprised of P-channel transistors 70 and 71, coupled to define drain output terminal 73, two additional C-MOS inverter stages, comprised of P-channel transistors 74 and 76 and N-channel transistors 75 and 77, are provided. The source elecrodes of P-channel transistors 70, 74 and 76 are coupled to a reference potential, such as ground. The source electrodes of the N-channel transistors 71, 75 and 77 are coupled through a switching transistor 78 to the supply potential $-V_{SS}$, in order to cut-off the flow of current through the respective C-MOS inverter stages when the switching transistor 78 is turned OFF. Accordingly, the switching transistor 78 is turned OFF when the load condition of the rotor is not being detected in order to prevent useless current consumption from being effected by the load detection circuit when no detection is being performed thereby. It is noted that in a conventional electronic wristwatch, the time required to effect a driving, or stepping, of the rotor including the vibrational damping that occurs when the rotor has completed its 180° rotation, is on the order of ten m-sec. to thirty m-sec. Thus, if switching transistor 78 is turned OFF for 970 to 990 m-sec. and is turned ON for the remaining ten to thirty m-sec. in each minute, in order to effect a stepping of the rotor to increment the second hand once each second, the detection circuit can operate during the ten to thirty m-sec. interval, and thereby effect a reduction in the biasing current on the order of 1/30 to 1/100 of the current consumed by the detection circuit depicted in FIG. 11.

As aforenoted, by coupling the source electrodes of each of the N-channel transistors 71, 75 and 77 to switching transistor 78, the bias current in each of the inverter stages is interrupted in response to actuating switching transistor 78. However, if the switching transistor 78 were only coupled to the first C-MOS inverter stage, comprised of P-channel transistor 70 and N-channel transistor 71, the voltage drop across the first inverter stage would be different than the voltage drop in the following stages. Specifically, because of the channel resistance of the switching transistor 78, a greater biasing current would be required in the first inverter stage, and hence would result in an error in the detection of the current peaks produced by the voltage induced in the drive coil after the step motor is rotated.

Figure 13:
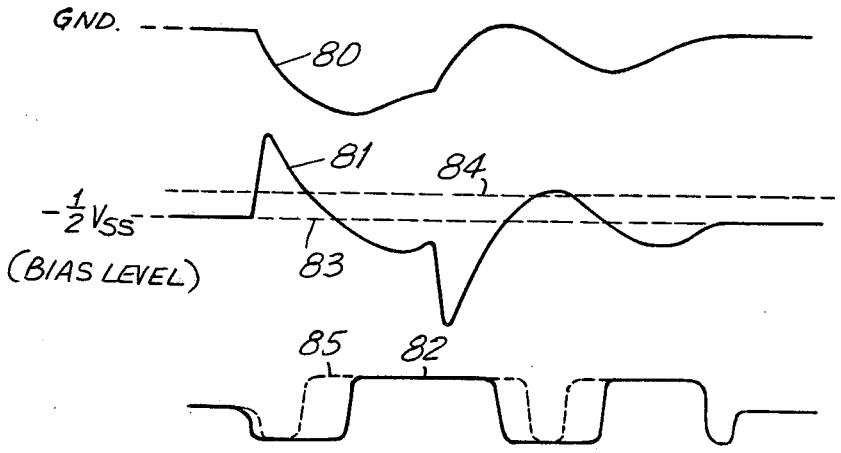
FIG. 13 is a wave diagram illustrating the operation of the load detection circuit depicted in FIG. 12.

This point is illustrated in FIG. 13, wherein the signal 80 represents the signal applied through the capacitor 72 to the input of the first stage of the C-MOS inverter, depicted in FIG. 12. The signal produced at the drain output 73 of the first C-MOS inverter stage is the signal 81, and in response thereto, a signal 82 is produced at the drain output 96 of the second C-MOS inverter stage comprised of P-channel transistor 74 and N-channel transistor 75. It is noted, however, that if switching transistor 78 were only coupled to the first C-MOS inverter stage, so that the source electrode of N-channel transistor 75 and 77 were directly coupled to the negative terminal $-V_{SS}$ of the voltage supply, the difference in the biasing level between the first C-MOS inverter stage and the second and third C-MOS inverter stages is represented by the difference between the dashed lines 83 and 84, depicted in FIG. 13. Moreover, this difference would result in an output signal being produced at the output of the second C-MOS inverter stage, illustrated by the dashed line 85. As is illustrated in FIG. 13, the signal 85 does not have leading edges that correspond to the current peaks of the input signal 80 applied through the input capacitor 72 and, accordingly, do not produce a load detection signal representative of the current peak produced by the voltage induced in the drive coil after each stepping of the rotor. It is therefore necessary for the switching transistor 78 to be coupled to each of the stages, in order to assure that an uneven voltage drop across the respective stages is not effected, in order to assure that the load detection signal, produced at the output 79, is representative of the current peaks of the input signal applied to the load detection circuit.

Figure 14:
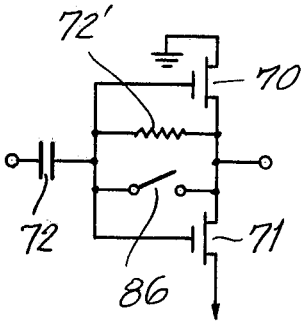
FIG. 14 is a circuit diagram of a further embodiment of the load detection circuit depicted in FIG. 12.

Reference is now made to FIG. 14, wherein a differentiator circuit, constructed in accordance with a further embodiment of the instant invention, is depicted, like reference numerals being utilized to denote like elements described above. A switch 86 is coupled in parallel with the resistor 72' between the drain output terminal 73 and gate input terminals of the C-MOS inverter stage. It is noted that in FIG. 12, when the switching transistor 78 is turned OFF, the potential at the drain of the transistor 78 is referenced to ground as a result of the cutting off of the current applied to each of the inverter stages by the switching transistor 78. As a result thereof, the gate electrodes of transistors 70 and 71 are referenced to ground, which potential is higher than the biasing level of the gate electrodes during the interval of time that switching transistor 78 is turned ON and the current peaks in the input signal are being detected. However, when the transistor 78 is turned ON, the potential of the gate and drain terminals of the respective C-MOS transistors return to the biasing level during the period that the current peaks of the input signal are detected. Also, at this time, the charge stored in the capacitor is discharged through the feedback resistor 72'. Accordingly, the RC constant, defined by the feedback resistor 72' and capacitor 72, define a minimum time interval that is required to obtain a stable biasing level in at least the first C-MOS inverter stage.

As is illustrated in FIG. 14, by utilizing a switch 86, coupled in parallel with the feedback register, the time required to stabilize the C-MOS inverter stage at the biasing level is shortened by permitting the charge stored in the capacitor to be discharged through the switch 86, thereby shortening the RC constant, defined by the capacitor 72 and resistor 72'. Specifically, prior to the period that the voltage induced in the drive coil is detected, the switch 86 is turned ON, the biasing level of the first C-MOS inverter stage can be stabilized, whereafter the switch 86 can be turned OFF for the entire interval that the differentiator circuit is detecting the current peaks in the input signal applied thereto.

Figure 15:
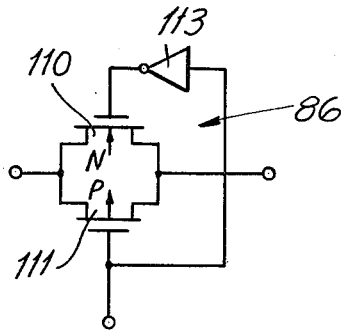
FIG. 15 is a circuit diagram of a switch circuit for use in the load detection circuit depicted in FIG. 14.

Reference is now made to FIG. 15, wherein a detailed circuit embodiment of the switch 86, utilized for stabilizing the biasing level of the first C-MOS inverter stage, is depicted. N-channel transistor 110 and P-channel transistor 111 are series-coupled and have a closed loop defined between the gate electrodes thereof by an inverter 113. Accordingly, the drain terminals and source terminals are coupled with respect to each other to define an input and output, respectively, and thereby define a bi-directional switching operation for stabilizing the biasing level of the C-MOS inverter stage of the differentiator circuit, in the manner detailed above.

Figure 16:
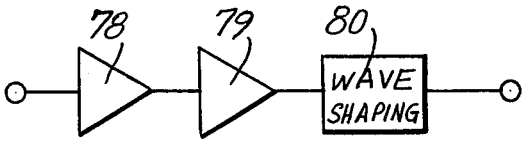
FIG. 16 is a block circuit diatram of the load detection circuit depicted in FIG. 9.
Figure 17:
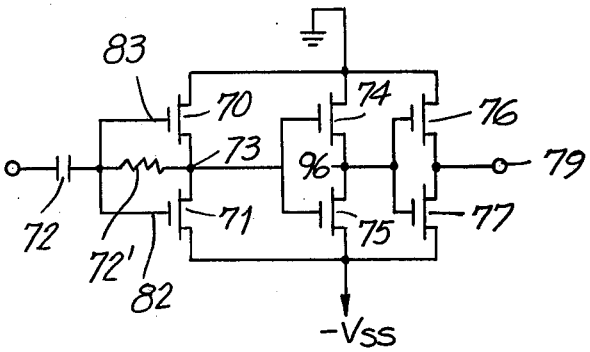
FIG. 17 is a circuit diagram of still a further embodiment of the load detection circuit constructed in accordance with the instant invention.

Turning now to FIG. 16, amplifiers 78 and 79 illustrate the manner in which inverter-amplifiers are series-coupled in connection with a wave shaping circuit 80 in order to apply a load detection signal to the NAND gate *29a* that is representative of the load placed upon the step motor. To this end, reference is made to FIG. 17, wherein a three-inverter stage differentiation circuit, of the type depicted in FIG. 12, is provided, like reference numerals being utilized to denote like elements described above. It is noted however that the switching transistor is omitted, thereby causing the voltage level at which the circuit is biased to be determined by the gate voltage characteristics and channel resistance of P-channel MOS transistor 70 and N-channel MOS transistor 71. As in the examples detailed above, if an output signal is to be produced at the output terminal 79 of the differentiation circuit, that has a sufficient amplitude and leading edges representative of the current peaks of the input signal applied thereto, the dimensional characteristics of the C-MOS transistors, defining each of the inverter stages, must be constructed and arranged to reduce the bias voltage levels to one-half that of the supply voltage $-V_{SS}$. Accordingly, the differentiator circuit, depicted in FIG. 17, is characterized by each of the P-channel and N-channel transistors having the same physical construction and amplification characteristics.

Figure 18:
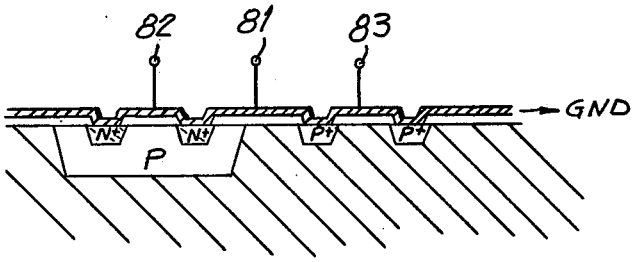
FIG. 18 is a sectional view of a C-MOS inverter stage construction depicted in FIG. 17.
Figure 19:
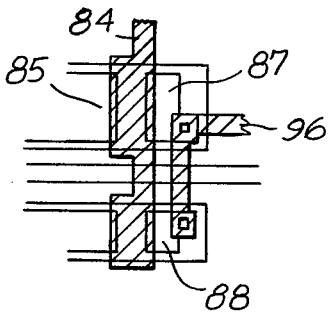
FIG. 19 is a plan view of the C-MOS inverter stage construction depicted in FIG. 18.

With respect to the construction of each C-MOS inverter stage, reference is made to FIGS. 18 and 19, wherein the first C-MOS inverter stage is depicted. P-channel MOS transistor 70 includes a gate electrode 82 and N-channel MOS transistor 71 includes a gate electrode 83, the output 73 of the first C-MOS inverter stage being coupled to the common gate input terminal of the second C-MOS inverter stage having the same impedance characteristic as the first C-MOS inverter stage. As is particularly illustrated in FIG. 19, electrode 85 is referenced to a ground potential, whereas region 86 is coupled to the negative terminal of the voltage supply $V_{SS}$. Additionally, the source output electrode 96 corresponds to the electrode 73, depicted in FIG. 18. Finally, electrode 84 couples the gate terminals of the respective P-channel and N-channel MOS transistors together and defines the gate electrode of the N-channel transistor 71, illustrated in FIG. 18.

Figure 20:
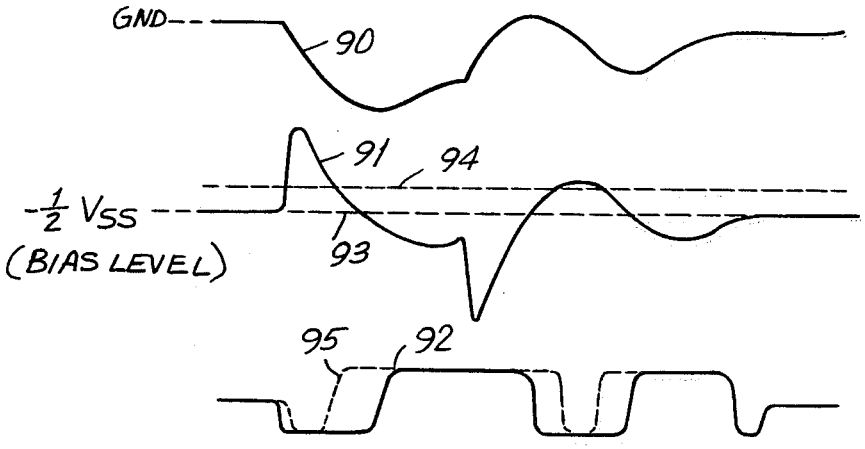
FIG. 20 is a wave diagram illustrating the operation of the load detection circuit depicted in FIG. 17.

Turning now to FIG. 20, the input signal 90, produced by the respective transmission gates 53 and 54, depicted in FIG. 9, in response to the current induced in the drive coil after each application of the drive pulse thereto, is illustrated as input signal 90. As in the example detailed above with respect to FIG. 13, an output signal 91 is produced at the output 73 of the first C-MOS inverter stage. If, in accordance with the instant invention, the bias level of the second C-MOS inverter stage, comprised of C-MOS transistors 74 and 75, is the same as the first C-MOS inverter stage, an output signal 92 is produced at the drain output 96 of the second C-MOS inverter stage. Moreover, the leading edges of the output signal 92 will correspond to the current peaks of the input signal 90 applied to the differentiator circuit.

It is noted, however, that if the bias level of the second C-MOS inverter stage (illustrated as 94 in FIG. 20) is different than the bias level of the first C-MOS inverter stage (illustrated in FIG. 20 as 93), an output signal, illustrated by dashed line 95, will be produced at the output 96 of the second C-MOS inverter stage 96, the leading edges of which do not correspond to the current peaks of the wave form 90 applied to the first C-MOS inverter stage.

It is therefore apparent that the biasing level of the first C-MOS inverter stage must correspond to the biasing level of the second C-MOS inverter stage in order to assure that their amplification characteristics are the same. This matching of the biasing levels is obtained by assuring that the physical and electrical characteristics of both inverter stages are substantially identical. Moreover, if the amplitude of the signal, produced at the output of the second inverter stage, is insufficient, a third C-MOS inverter stage must be utilized that has the same biasing level as the first and second C-MOS inverter stages.

Figure 21:
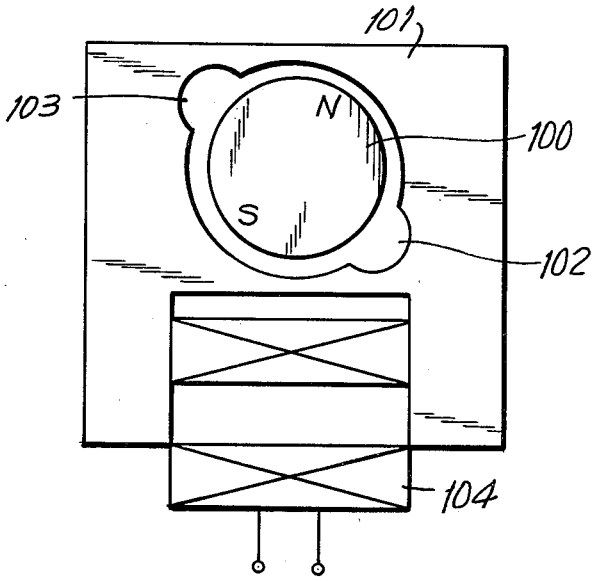
FIG. 21 is a plan view of a step motor constructed in accordance with an alternate embodiment of the instant invention.
Figure 22:
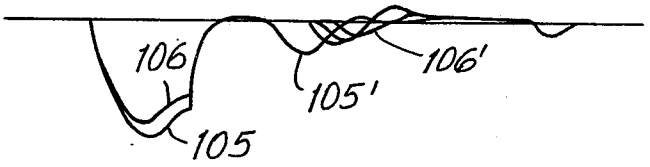
FIG. 22 is a wave diagram illustrating the current induced in the drive coil of the step motor depicted in FIG. 21.

It is noted that the instant invention is not limited to an electro-mechanical converter mechanism including the step motor depicted in FIG. 1. For example, the step motor depicted in FIG. 21 is particularly suitable for use in the instant invention. It is further noted that a single stator plate 101, having no gap between the respective facing stator poles is utilized, with notches 102 and 103 being utilized to fix a static position of the rotor and insure the same is properly oriented to be rotated in a particular direction in response to the driving pulses being applied to the drive coil 104 thereof. The use of a one-piece stator plate 101 and notches 102 and 103 surrounding the rotor 100, causes a different current to be induced in the drive coil after driving than the current induced by the step motor depicted in FIG. 1. Specifically, when no load is placed upon the rotor, the signal 105, depicted in FIG. 22, represents the current induced in the drive coil in response to driving, and the wave form 105' represents the current induced in the drive coil upon completion of the rotor being rotated. Similarly, wave form 106 illustrates the current induced in the rotor during driving with the portion 106' thereof representing the current induced in the drive coil at the completion of the drive signal, when a heavier load is placed upon the rotor. In any event, FIG. 12 ilustrates that the relative current minimums of the signals 106 and 105 clearly occur at different times as a result of the load placed upon the rotor, and hence are readily detected in order to be utilized to control the duration of the pulse width of the drive signal applied to the step motor to effect driving of same.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An electronic timepiece comprising in combination oscillator means for producing a high frequency time standard signal, divider circuit means for producing low frequency time signals in response to said high frequency time standard signal; a step motor including a drive coil for receiving a drive signal and being stepped in response thereto; a gear train driven by said step motor and adapted to place the step motor in one of a first normally loaded condition and a second more heavily loaded condition; load detection means including C-MOS differentiator circuit means for detecting current peaks in the current signal induced in the drive coil of the step motor after each application of a drive signal thereto for producing a load detection signal representative of the load condition placed upon the step motor, said differentiator circuit means including at least two C-MOS inverter stages, each of said C-MOS inverter stages being fabricated in a substrate and having substantially the same dimensional characteristics and equivalent electrical characteristics so that each said C-MOS inverter stage admits of the same biasing level; driving and control means intermediate said divider circuit means and said step motor for receiving the low frequency signal from the dividing circuit means and said load detection signal, said driving and control means being adapted to apply a drive signal having a predetermined pulse width of said step motor in response to a first normally loaded condition being detected, said driving and control circuit means in response to said more heavily loaded condition being detected applying to said step motor a second drive signal having a pulse width of duration longer than said first pulse width.

2. An electronic timepiece comprising in combination oscillator means for producing a high frequency time standard signal, divider circuit means for producing low frequency time signals in response to said high frequency time standard signal; a step motor including a drive coil for receiving a drive signal and being stepped in response thereto; a gear train driven by said step motor and adapted to place the step motor in one of a first normally loaded condition and a second more heavily loaded condition; load detection means including C-MOS differentiator circuit means for detecting current peaks in the current signal induced in the drive coil of the step motor after each application of a drive signal thereto for producing a load detection signal representative of the load condition placed upon the step motor; driving and control means intermediate said divider circuit means and said step motor for receiving the low frequency signal from the dividing circuit means and said load detection signal, said driving and control means being adapted to apply a drive signal having a predetermined pulse width to said step motor in response to a first normally loaded condition being detected, said driving and control circuit means in response to said more heavily loaded condition being detected applying to said step motor a second drive signal having a pulse width of duration longer than said first pulse width; a voltage supply for applying an energizing voltage to said divider circuit means, load detection means and driving and control means, and switching means coupled intermediate said voltage supply and said C-MOS differentiator circuit means for cutting off the energizing voltage applied to said differentiator circuit means in the absence of said current induced in said drive coil being detected by said load detection means to thereby reduce the current consumed by said differential circuit means.

3. An electronic timepiece as claimed in claim 2, wherein said differentiator circuit means includes at least two series-connected C-MOS inverter stages, said switching means being coupled to each C-MOS inverter stages to cut-off the energizing voltage applied thereto by said voltage supply in the absence of said current induced in said drive coil being detected by said load detection means.

4. An electronic timepiece as claimed in claim 3, wherein the same polarity transistor in each C-MOS inverter stage is coupled to said switching means.

5. An electronic timepiece as claimed in claim 2, wherein said switching means is an MOS transistor having its source-drain path coupled in series between said voltage supply means and the same polarity transistor in each C-MOS inverter stage.

6. An electronic timepiece as claimed in claim 3, and including feedback resistance means and input capacitance means, the drain output terminal of said first C-MOS inverter stage being coupled through said feedback resistance means to the gate input terminals of said first C-MOS inverter stage, said input capacitance means being coupled intermediate said drive coil and said gate input terminal of said first C-MOS inverter stage so that said input capacitance means and feedback resistance means define a minimum RC time interval required for said differentiator circuit means to be stabilized at a biasing level after said energizing voltage is applied thereto.

7. An electronic timepiece as claimed in claim 6, and including second switching means coupled in parallel with said feedback resistance means, said second switching means being adapted to be selectively closed immediately prior to the termination of said driving signal to said step motor to thereby shorten the RC time interval defined by said input capacitance means and feedback resistance means and, hence, shorten the interval of time required to stabilize said differentiator circuit means in response to said energizing voltage being supplied thereto.

8. An electronic timepiece as claimed in claim 7, wherein said second switch means is a bi-stable switching circuit including a pair of series-connected P-channel and N-channel transistors.

9. An electronic timepiece as claimed in claim 1, wherein the stable biasing level of said first C-MOS inverter stage and second C-MOS inverter stage are equal, to thereby assure that said current peaks in said current signal induced in said drive coil of said step motor are accurately detected.

* * * * *